US007114986B1

(12) United States Patent
Toly

(10) Patent No.: US 7,114,986 B1
(45) Date of Patent: Oct. 3, 2006

(54) ELECTRICAL CORD CONNECTOR APPARATUS

(76) Inventor: Elde V. (Bud) Toly, 109 Bulkley Ave., Sausalito, CA (US) 94965

( * ) Notice: Subject to any disclaimer, the term of this patent is extended or adjusted under 35 U.S.C. 154(b) by 0 days.

(21) Appl. No.: 11/033,345

(22) Filed: Jan. 10, 2005

Related U.S. Application Data

(60) Provisional application No. 60/535,416, filed on Jan. 9, 2004.

(51) Int. Cl.
*H01R 11/20* (2006.01)
*H01R 4/26* (2006.01)

(52) U.S. Cl. ..... 439/441; 439/685

(58) Field of Classification Search ..... 439/441, 439/685, 834–835, 783, 717
See application file for complete search history.

(56) References Cited

U.S. PATENT DOCUMENTS

| | | | | |
|---|---|---|---|---|
| 6,146,217 | A * | 11/2000 | Osada | 439/835 |
| 6,250,950 | B1 * | 6/2001 | Pallai | 439/441 |
| 6,336,824 | B1 * | 1/2002 | Sorig | 439/441 |
| 6,689,955 | B1 * | 2/2004 | Doutaz | 174/65 R |
| 6,712,649 | B1 * | 3/2004 | Mano et al. | 439/835 |
| 2005/0090159 | A1 | 4/2005 | Luther et al. | 439/835 |

* cited by examiner

*Primary Examiner*—Michael C. Zarroli
(74) *Attorney, Agent, or Firm*—Craig M. Stainbrook; Stainbrook & Stainbrook, LLP

(57) ABSTRACT

An electrical connector adapted for use in terminating the individual solid and/or stranded wires of a NEMA cable includes a locking connector body having a plurality of nested cam levers, each of which selectively rotates to engage a spring clamp to releasably capture a conductor within the connector body, and without the need of inserting a tool into the device.

8 Claims, 6 Drawing Sheets

ELECTRICAL CORD CONNECTOR APPARATUS

CROSS REFERENCE TO RELATED APPLICATIONS

The present application claims the benefit of the filing date of U.S. Provisional Patent Application Ser. No. 60/535,416, filed 9 Jan. 2004.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to electrical plugs and connectors, and more particularly to an improved electrical cord connector or wire terminator for a NEMA (National Electrical Manufacturers Association) cord or cable.

BACKGROUND INFORMATION AND DISCUSSION OF RELATED ART

Extension cords are widely employed to provide power to tools and equipment which are remote from electrical outlets and power sources. The extension cords are routinely placed under significant stress, and therefor the connector and plug housings have been improved over the years to include means to securely clamp the cord while minimizing the strain on the terminals. NEMA connectors and plugs generally include an internal mechanical clamp terminal that cooperates with the housing or body to hold a conductor in place. Contact pressure for the clamp terminal is generally provided by a screw threaded through a contact lug which urges the conductor against a current bar, contact tang, or other current carrying element. Examples of such devices include both the 20 and 30 amp locking plugs and connector bodies manufactured either by Marinco Industrial Group of Napa, Calif., or Hubbell Incorporated of Milford, Conn.

Improvements in electrical terminals have been made for use in high density terminal busses. Several United States patents teach the use of electrical connectors of a type that includes a bus bar with a loop-shaped clamping spring fabricated from flat spring material. The connectors typically include a contact portion in electrical contract with the bus bar and a clamping portion extending to the bus bar and curving away from the back of the clamping spring. The clamping spring further includes a curved backward spring segment contiguous with the back of the spring and with the contact portion. The clamping portion has a recess, from which the head of the bus bar extends, such that an edge of the clamping recess clamps an electrical conductor against the underside of the bus bar when the conductor is inserted between the bus bar and the edge of the clamping recess.

The springs have themselves become the focus of rapid development. For instance, U.S. Pat. No. 5,816,867 to Davidsz et al., shows a curved wire spring clamp for use in an electrical terminal. Apertures in the clamp approximate a triangular cantilever and are centrally placed along each leg portion near a constrained curved portion of the spring to change the spring's bending characteristics and distribute the bending stress more evenly throughout the length of the spring, thus reducing the peak bending stress level as compared with an equivalent spring design without apertures.

U.S. Pat. No. 6,010,376 to Kollmann, teaches a low profile connector having a clamping spring with a low structural height. Actuation of the clamping spring for inserting the end of a conductor requires insertion of a tool (generally a screwdriver).

U.S. Pat. No. 6,283,801 to Guinda et al., shows a spring connection terminal for an electrical device which includes a conducting support part fixed to a main conducting part, and at least one clamping spring folded into the form of a loop and provided with a clamping window inside which a flange of the support part passes. It further includes a spring stop folded so as to be housed inside the spring loop and which forms a guide for guiding the wire adjacent to the flange. The device requires insertion of a screwdriver head to insert a conductor.

U.S. Pat. No. 6,595,809 to Matsumoto et al., discloses a high density electrical bus employing a connector having toggle switches that engage clamping springs. When the toggle arm is pushed inwardly, the spring clamp opens to accommodate a wire conductor; and when released, the conductor is captured. The assembly is suited for use in a linear array of terminals but not for a NEMA connector or plug.

U.S. Pat. No. 6,428,339 to Davidson et al., teaches a lockable electrical cord connector unit having a cylindrical connector housing made of electrically non-conductive material. A locking control ring telescopes over the connector housing and is mechanically connected to a structure within the connector housing that allows male electrical connector members extending from the housing to be locked into a female electrical socket. In an alternative embodiment the connector housing may have female sockets that can lock onto a male electrical terminal by using the same locking control ring structure. A second alternative embodiment provides for the connector housing to be an adaptor having male electrical terminal prongs extending from one end and having a female electrical socket formed in its other end. The locking ring allows both ends to be locked to mating electrical terminals.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

In fact, despite the advances in spring clamps for high density terminal busses, there remains a need to provide a locking plug and/or connector body having means for efficient (e.g., straight-in) insertion of a conductor for termination in the connector/plug body, wherein no tool is required to bias a clamping spring nor any screw engaged to provide clamping pressure on the conductor.

BRIEF SUMMARY OF THE INVENTION

The electrical cord connector apparatus of the present invention provides an improved electrical connector adapted for use in terminating the individual solid and/or stranded wires of a NEMA cable. In its most essential aspect, the invention comprises a locking plug or connector body which includes a plurality of nested cam levers, each of which selectively rotates to engage a spring clamp to releasably capture a conductor within the connector body, and without the need of inserting a tool into the device.

It is therefore an object of the present invention to provide a new and improved electrical cord connector.

It is another object of the present invention to provide a new and improved connector for solid or stranded wires of a NEMA cable.

A further object or feature of the present invention is a new and improved connector body enabling efficient insertion of a conductor.

An even further object of the present invention is to provide a novel conductor clamping spring configuration.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
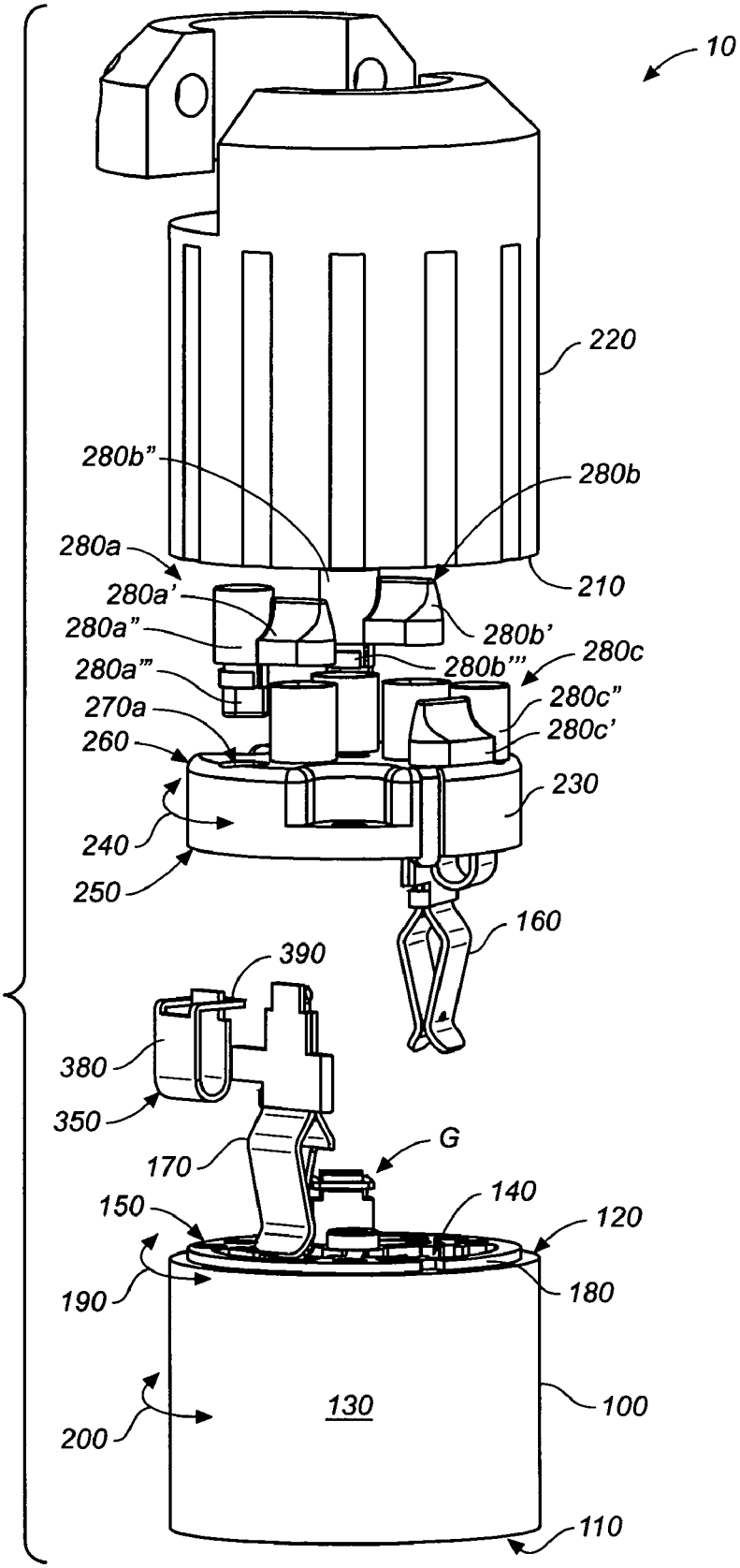
FIG. 1 is an exploded perspective view showing the essential components comprising the improved electrical cord connector apparatus of the present invention.

Referring to FIGS. 1 through 6, wherein like reference numerals refer to like components in the various views, there is illustrated therein a new and improved electrical cord connector apparatus, generally denominated 10 herein. In a preferred embodiment of the present invention, the connector comprises connector housing 100 (which is preferably cylindrical, but may be of other appropriate shape such as a polygon), having a front wall 110, a rear wall 120, an exterior side 130 (or sides, if polygonal), and at least two interior chambers 140, 150, for accommodating at least hot and neutral electrical terminals 160, 170. This view shows female receptacle clips, though it will be readily appreciated by those with skill in the art that the terminals described herein could include other types of terminals including male (e.g. prong) members, as well. The terminals preferably include a hot terminal, a neutral terminal, and a ground terminal G.

The rear wall 120 of the housing 100 includes an elevated annular portion 180 having a slightly smaller circumference 190 than the circumference 200 of the exterior side 130 of the housing. Thus, an annular surface is defined on rear wall 120 for mating with the lower rim 210 of a cylindrical cover or enclosure 220. The enclosure may be adapted for screwing onto the housing 100, or it may be provided with other means for attachment, such as screws or clamps.

The connector further comprises an intermediate base portion 230 interposed between the cover and the housing, which provides a platform for the novel working elements of the present invention. Specifically, base portion 230 preferably has an outer circumference 240 which matches circumference 190 of elevated annular portion 180. It includes a front side 250 and a rear side 260, and a plurality of through holes 270*a* (through holes 270*b* and 270*c* not shown) extending from the front to the rear side. Each through hole is adapted for the installation of a cam and lever assembly 280*a–c*, each assembly including a lever arm 280*a*', 280*b*', and 280*c*', each arm disposed from the circumferential surface of a barrel portion 280*a*", 280*b*", and 280*c*"; and an arcuate cam tang 280*a*'", 280*b*'", and 280*c*'" (which is not visible in this view) integral with and extending downwardly from the barrel portion.

In effect, base portion 230 functions as a boss manifold for the installation and support of a number of cam lever assemblies 280*a–c*. When assembled, the cam assemblies are disposed atop the rear side 260 of the base portion 230 and the lever arms 280*a*', 280*b*', and 280*c*' are contained within circumference 240. Accordingly, cover 220 surrounds and encloses the entire base portion and the working elements included therein.

Figure 2:
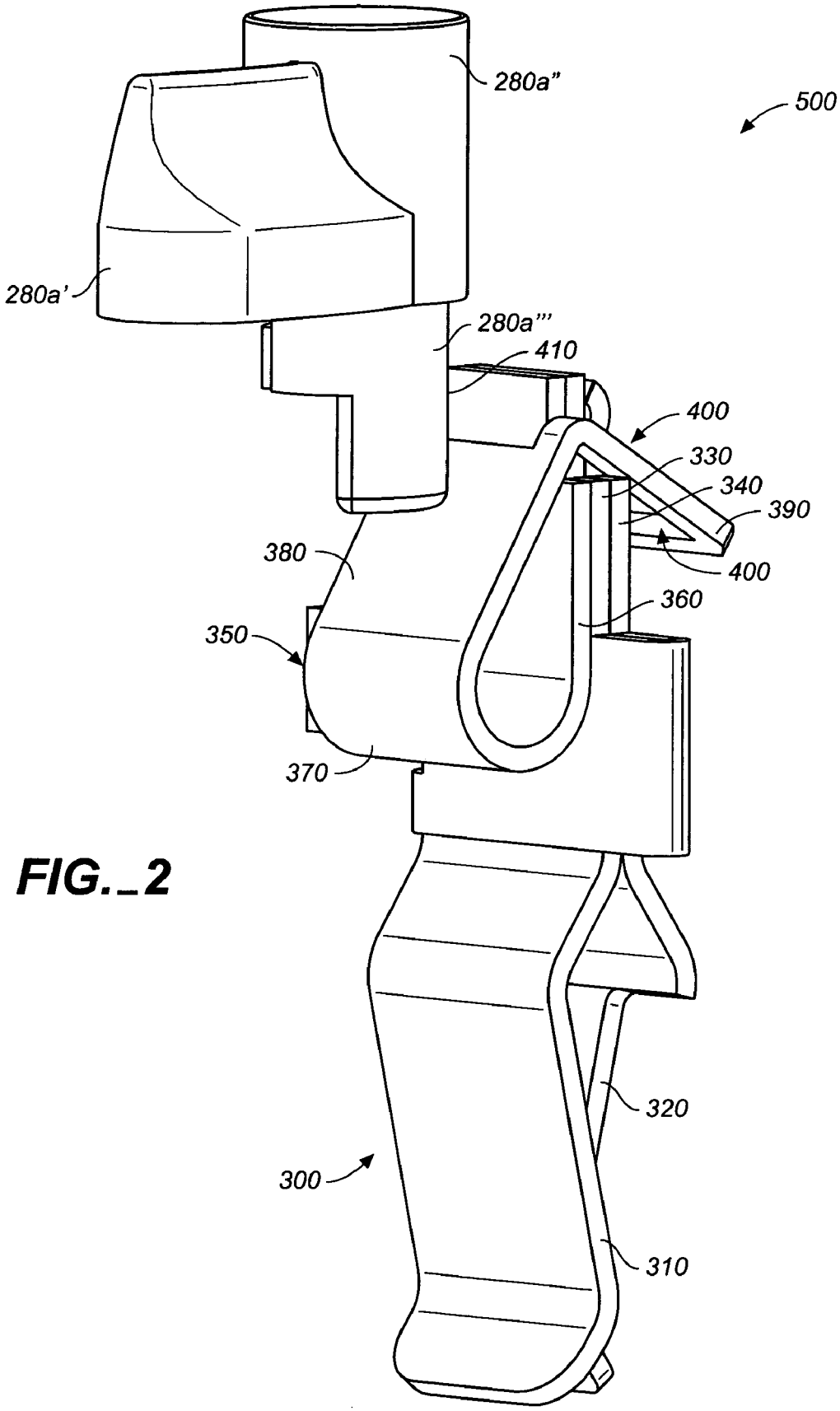
FIG. 2 is a detailed perspective view of the terminal receptacle and wire clamping assembly of the present invention, showing the clamping spring of the assembly biased by a cam lever into an open configuration, such as would be suitable for accepting the terminal end of a wire.
Figure 3:
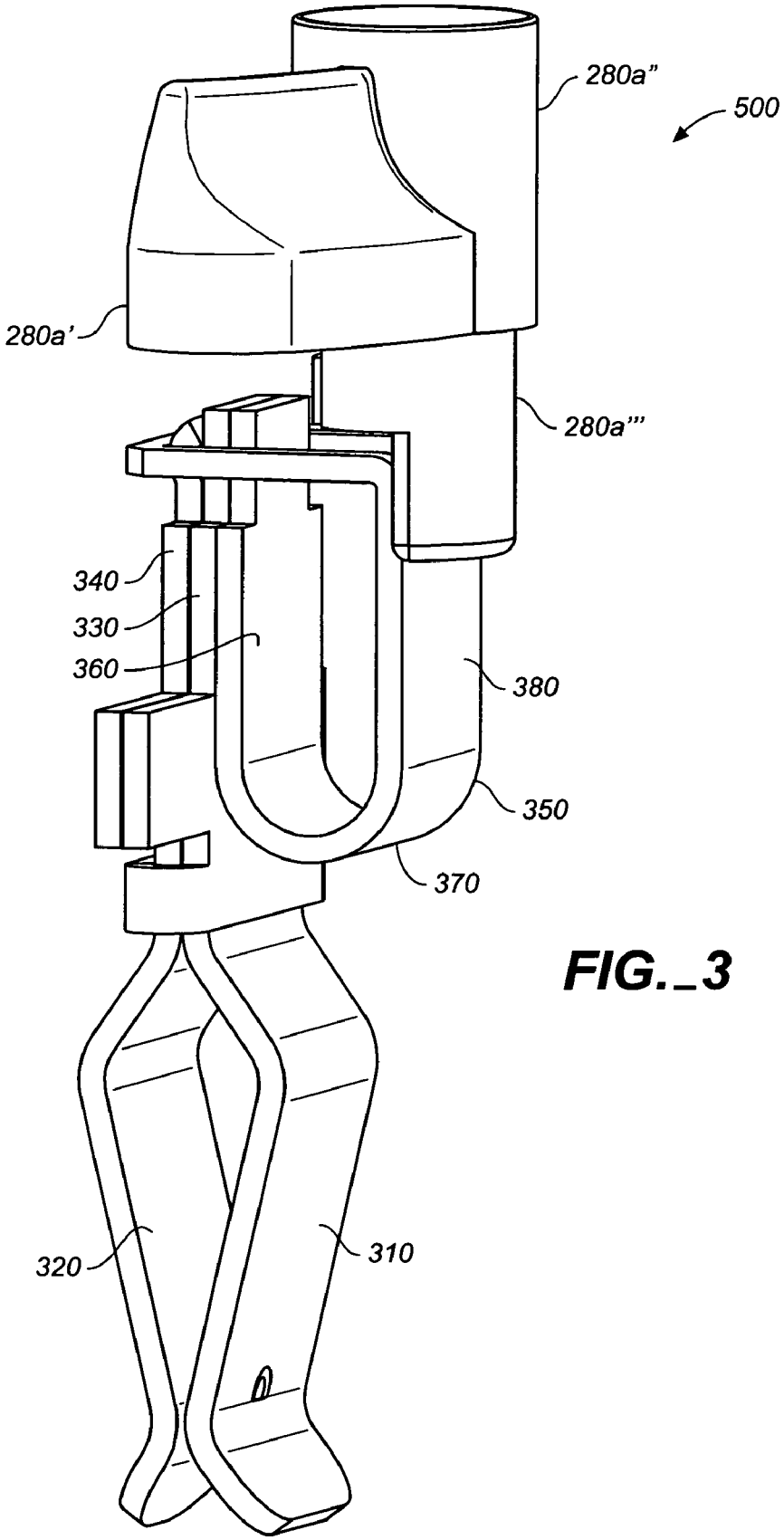
FIG. 3 is a detailed perspective view of the receptacle and wire clamping assembly showing the clamping spring closed and the cam lever positioned for nesting within the connector enclosure.
Figure 4:
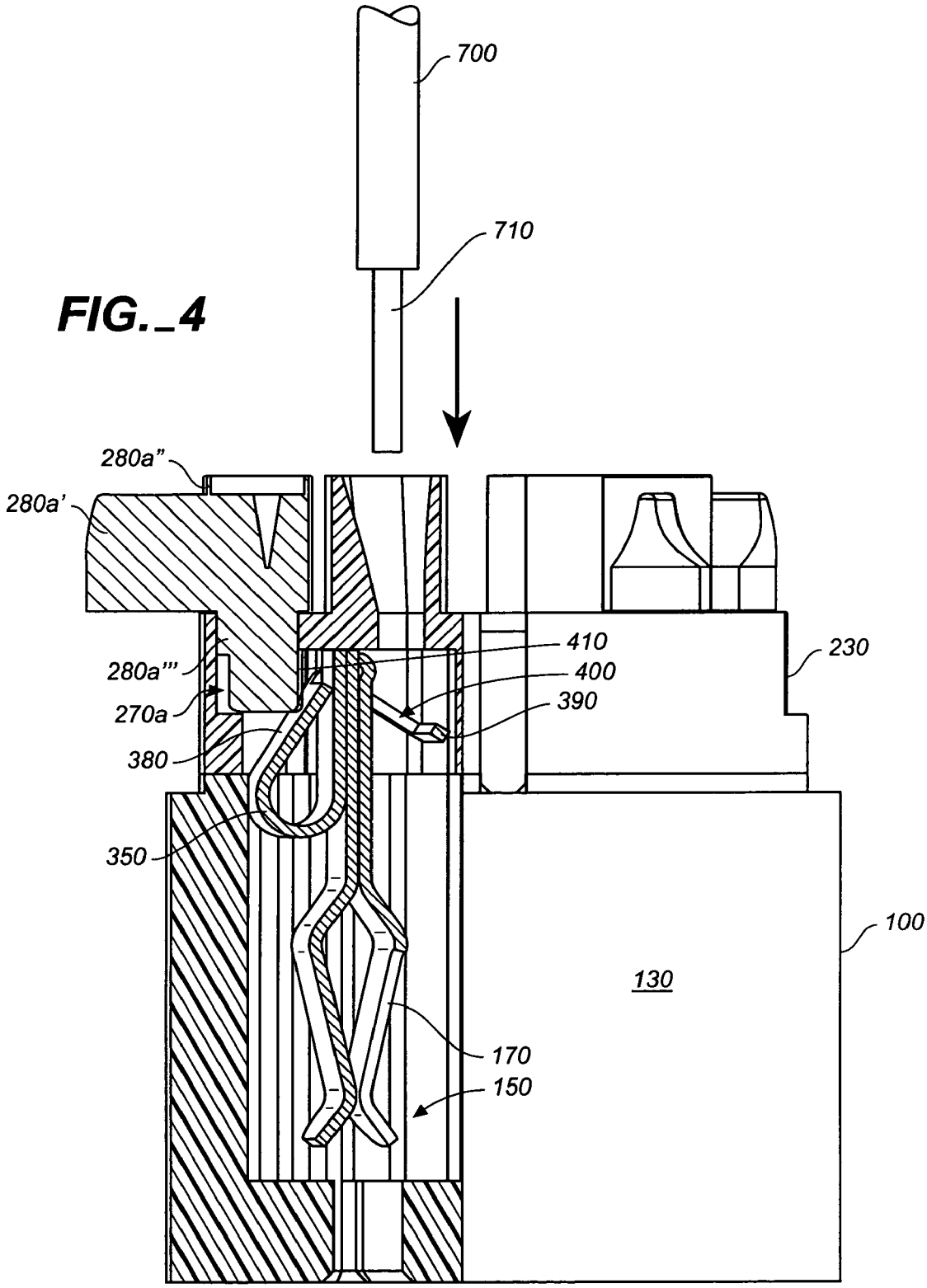
FIG. 4 is a cross-sectional side elevation view showing the inventive connector with a wire end being inserted into the opening created by an open clamping assembly.

Referring now to FIGS. 2 and 3, it will be seen that the terminals include a two-sided conductive receptacle clip 300, each side 310, 320 of which extends upwardly in a bar 330, 340 to form mating planar surfaces, and one of which (310) is brought into face-to-face electrical communication with an integral or welded looped clamping spring 350. The clamping spring includes a fixed or stationary portion 360 affixed to bar 330, a bend 370, a moving portion 380, and a frame 390 cantilevered at a substantially right angle from the moving portion to selectively define an aperture or window 400 for insertion of a conductor when the spring is biased by the cam tang (FIG. 2).

The receptacle clips and cam assemblies each form a wire clamping assembly 500, the elements of which are shown in FIGS. 2 and 3. FIG. 3 shows the clamping assembly with the clamping spring closed and the lever arm 280*a*' positioned for nesting within the connector enclosure. FIG. 2 shows the lever arm 280*a*' rotated outwardly and the cam tang 280*a*'" biasing the moving portion 380 of clamping spring 350 into an open configuration, wherein frame 390 moves away from bar 340 and window 400 opens for accepting a conductor. This configuration is also shown in cross section in FIG. 4. In this configuration, the cam tang 280*a*'" is fully rotated into a stable open position such that its edge 410 engages the flat surface of spring moving portion 380. The resilient force of the spring preferably secures the lever arm 280*a*' in the open position, though this can be complemented with a stop on the base portion 230 and shaping of the tang edge 410 to flatten it when window 400 reaches the maximally open position.

Figure 5:
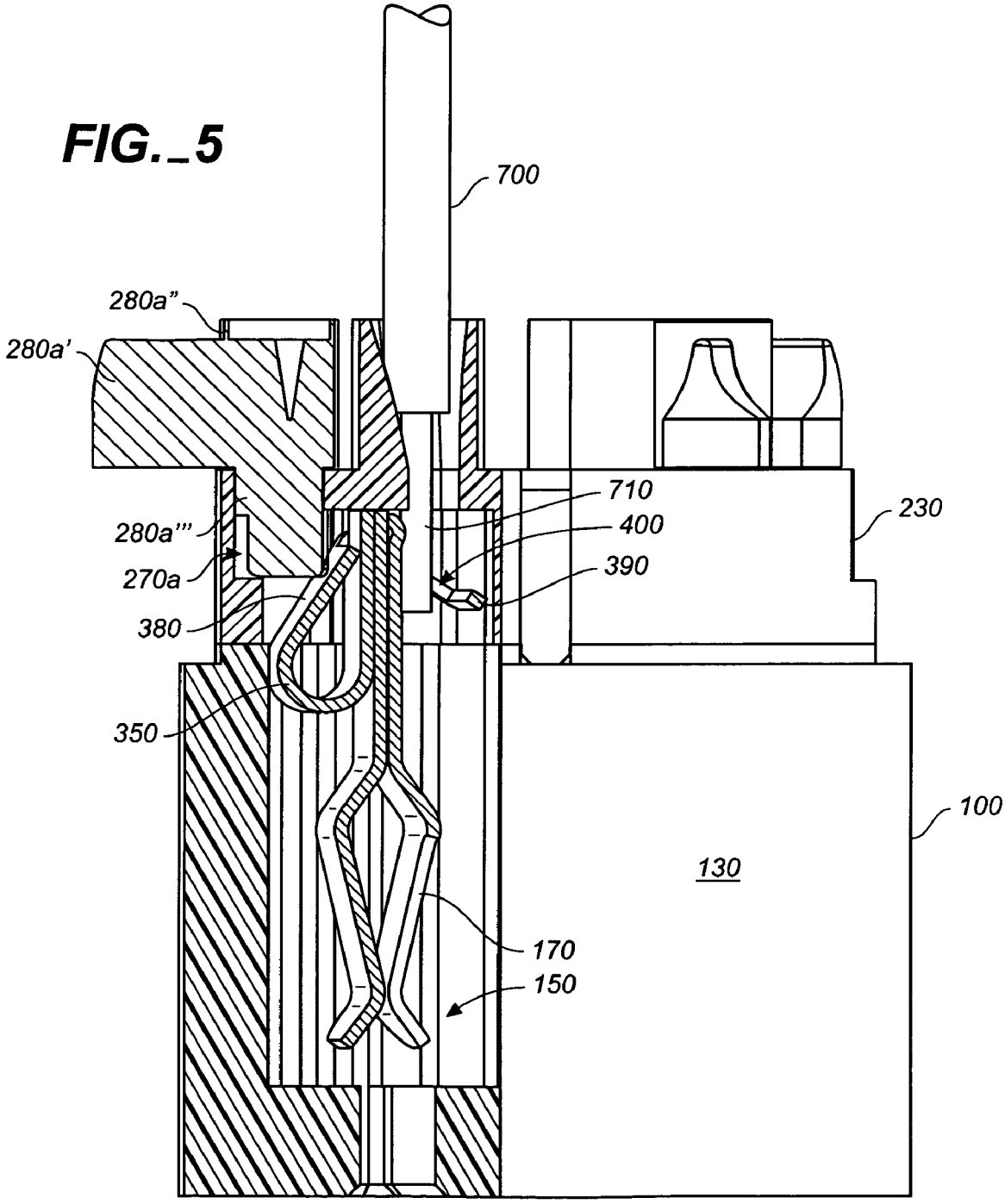
FIG. 5 is a cross-sectional side elevation view showing the terminal end of a solid wire inserted into by the clamping assembly.
Figure 6:
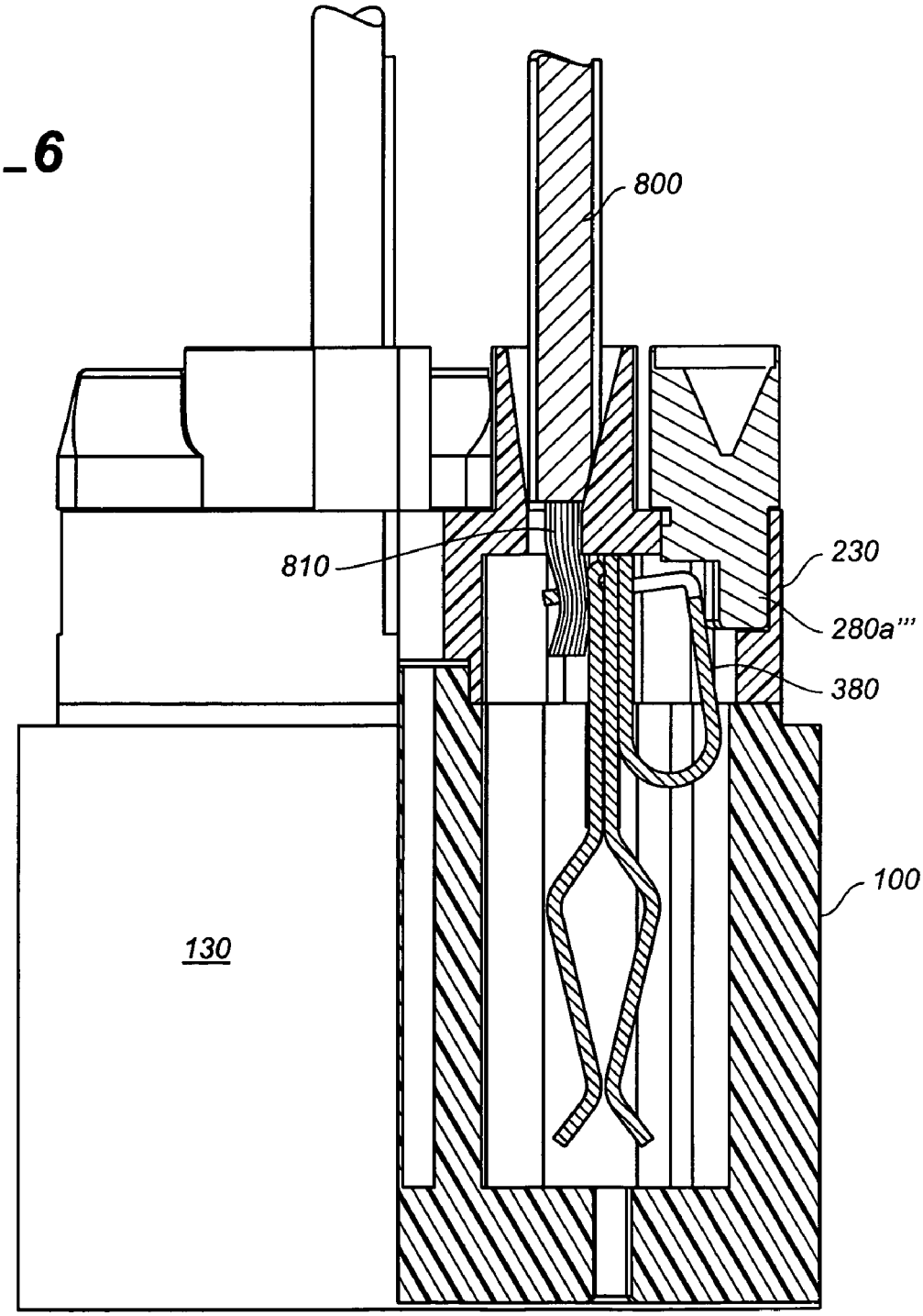
FIG. 6 is a cross-sectional side elevation view showing the terminal end of a stranded wire captured by the clamping assembly.

FIG. 5 shows how a wire 700 having an uninsulated end 710 is inserted into window 400 when clamping spring 350 is opened with cam lever arm 280*a*', while FIG. 6 shows how a stranded wire 800 having an uninsulated end 810 is captured and retained in the inventive clamping assembly when the clamping spring is closed.

The inventive electrical cord connector has numerous advantages over prior art devices having screw-type terminal clamps. It eliminates the "creep" resulting from the cold flow of strands in stranded wire, and it eliminates terminal self-loosening resulting from heat. It provides a flat clamping face having an increased surface area to increase contact between the conductor and the terminal. It is vibration and shock resistant. It provides a safer, more efficient means of installing conductors in the connector and eliminates the need for the insertion of tools, other than to remove the connector enclosure, if the enclosure is secured with screws.

The cam-effected conductor clamping mechanism of this invention can be configured in a number of ways. For example, while the lever arm used to move the cam tang and bias the clamping spring has been illustrated herein as swinging inwardly and outwardly (i.e., on an axis perpendicular to the rear side of the base portion), the lever arm could instead be configured to swing upwardly, downwardly, or in any other direction, to move a cam tang to bias the clamping spring.

Accordingly, the electrical cord connector apparatus of this invention may be characterized as a connector having a base portion; at least one electrical terminal in the base portion; at least one clamping spring in the base portion, the clamping spring having an open position to permit insertion of a conductor, and a closed position to urge the conductor against the electrical terminal; and a cam having a lever arm and a cam tang, the cam tang adapted to bias the clamping spring to the open position when the lever arm is in a first position, to permit insertion of a conductor, and when the lever arm is in a second position, the clamping spring urges the conductor against the electrical terminal.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed is:

1. An electrical cord connector apparatus comprising:

a connector housing having a front wall, a rear wall, an exterior side, and at least two interior chambers for accommodating at least hot and neutral electrical terminals;

a base portion disposed on said connector housing, and having a front side, a rear side, and an outer side;

an enclosure disposed over said outer side of said base portion and covering said base portion;

at least one electrical terminal in said base portion;

at least one clamping spring in said base portion, said clamping spring having an open position to permit insertion of a conductor, and a closed position to urge the conductor against said electrical terminal; and at least one cam and lever assembly, each having a lever arm and a cam tang, said cam tang adapted to bias one of said clamping springs to said open position when said enclosure is removed from said base portion and said lever arm is in a first position to permit insertion of a conductor, and when said lever arm is in a second position, said clamping spring urges the conductor against said electrical terminal and said enclosure may be placed over said base portion so as to cover said base portion and said cam and lever assembly.

2. The electrical cord connector apparatus of claim 1 wherein said base portion includes at least one hot terminal, a ground terminal, and a neutral terminal.

3. The electrical cord connector apparatus of claim 1 wherein said base portion connects to said housing.

4. The electrical cord connector apparatus of claim 1 wherein said electrical terminal comprises a female receptacle clip or male contact.

5. The electrical cord connector apparatus of claim 1 wherein said cam and lever assembly further includes a barrel portion disposed between said lever arm and said cam tang and having a circumferential surface, said lever arm disposed from said circumferential surface, and wherein said cam tang is arcuate, integral with and extending downwardly from said barrel portion.

6. The electrical cord connector apparatus of claim 1 wherein said clamping spring comprises a stationary portion, a moving portion, and a frame portion cantilevered at a substantially right angle from said moving portion.

7. The electrical cord connector apparatus of claim 6 wherein said clamping spring selectively defines an aperture in said frame portion between said stationary portion and said moving portion for insertion of an electrical conductor when said clamping spring is biased by said cam tang.

8. The electrical cord connector apparatus of claim 1 wherein said cam lever rotates inwardly and outwardly on an axis perpendicular to said rear side of said base portion between said first position and said second position.

* * * * *